US009802688B1

(12) United States Patent
Tuchscherer et al.

(10) Patent No.: US 9,802,688 B1
(45) Date of Patent: Oct. 31, 2017

(54) SYSTEMS AND METHODS FOR MOUNTING A PROPULSION DEVICE WITH RESPECT TO A MARINE VESSEL

(71) Applicant: Brunswick Corporation, Lake Forest, IL (US)

(72) Inventors: Andrew Tuchscherer, Wauwatosa, WI (US); Jeffrey C. Etapa, Oakfield, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/483,214

(22) Filed: Apr. 10, 2017

Related U.S. Application Data

(63) Continuation-in-part of application No. 14/573,347, filed on Dec. 17, 2014, now abandoned.

(51) Int. Cl.

| | |
|---|---|
| ***B63H 20/12*** | (2006.01) |
| ***B63H 20/06*** | (2006.01) |
| ***H01F 7/18*** | (2006.01) |
| *B63H 20/00* | (2006.01) |

(52) U.S. Cl.
CPC ..... *B63H 20/06* (2013.01); *B63H 20/12* (2013.01); *H01F 7/18* (2013.01); *B63H 2020/003* (2013.01)

(58) Field of Classification Search
CPC ..... F16F 13/30; F16F 13/305; B63H 20/10; B63H 20/08
See application file for complete search history.

(56) References Cited

U.S. PATENT DOCUMENTS

| | | | |
|---|---|---|---|
| 4,050,359 | A | 9/1977 | Mayer |
| 4,872,857 | A | 10/1989 | Newman et al. |
| 4,893,800 | A | 1/1990 | Tabata |
| 4,925,414 | A | 5/1990 | Newman |
| 5,236,182 | A | 8/1993 | Aoki |

(Continued)

FOREIGN PATENT DOCUMENTS

| | | |
|---|---|---|
| EP | 1803961 | 2/2011 |
| EP | 2113681 | 10/2011 |
| WO | 96/33356 | 10/1996 |

OTHER PUBLICATIONS

U.S. Appl. No. 13/688,109, filed Nov. 28, 2012.
U.S. Appl. No. 14/594,228, filed Jan. 12, 2015.

*Primary Examiner* — Edwin Swinehart
(74) *Attorney, Agent, or Firm* — Andrus Intellectual Property Law, LLP

(57) ABSTRACT

A system comprises an elastic mount configured to support a propulsion device with respect to a marine vessel. The elastic mount contains an electromagnetic fluid. An electromagnet is configured so that increasing an amount of electricity applied to the electromagnet increases the shear strength of the electromagnetic fluid in the elastic mount and thereby decreases elasticity of the elastic mount, and so that decreasing the amount of electricity applied to the electromagnet decreases the shear strength of the electromagnetic fluid in the elastic mount and thereby increases the elasticity of the elastic mount. A controller automatically adapts the amount of electricity applied to the electromagnet during translation of the marine vessel so as to reduce the likelihood that the propulsion device impacts an adjacent structure on the marine.

20 Claims, 11 Drawing Sheets

(56) References Cited

U.S. PATENT DOCUMENTS

| | | | | |
|---|---|---|---|---|
| 5,707,263 | A | 1/1998 | Eick et al. | |
| 5,974,856 | A | 11/1999 | Elie | |
| 5,996,745 | A | 12/1999 | Jones, Jr. et al. | |
| 6,176,170 | B1 | 1/2001 | Uppgard et al. | |
| 6,183,321 | B1 | 2/2001 | Alby et al. | |
| 6,273,771 | B1 | 8/2001 | Buckley et al. | |
| 6,322,404 | B1 | 11/2001 | Magee et al. | |
| 6,419,534 | B1 | 7/2002 | Helsel et al. | |
| 6,830,492 | B1 | 12/2004 | Magee et al. | |
| 6,929,518 | B1 | 8/2005 | Sawyer et al. | |
| 6,942,530 | B1 | 9/2005 | Hall et al. | |
| 7,156,709 | B1 | 1/2007 | Staerzl et al. | |
| 7,244,152 | B1 | 7/2007 | Uppgard | |
| 7,896,304 | B1 | 3/2011 | Eichinger et al. | |
| 7,942,711 | B1 | 5/2011 | Swan | |
| 8,113,892 | B1 | 2/2012 | Gable et al. | |
| 9,205,906 | B1 | 12/2015 | Eichinger | |
| 9,481,434 | B1 | 11/2016 | Eichinger et al. | |
| 2002/0171186 | A1* | 11/2002 | Baudendistel ..... | F16F 13/305 267/140.15 |
| 2003/0025255 | A1* | 2/2003 | Gade ..... | F16F 13/305 267/140.15 |
| 2009/0276098 | A1 | 11/2009 | Bodie et al. | |

* cited by examiner

SYSTEMS AND METHODS FOR MOUNTING A PROPULSION DEVICE WITH RESPECT TO A MARINE VESSEL

CROSS REFERENCE TO RELATED APPLICATION

This application is a continuation-in-part of U.S. patent application Ser. No. 14/573,347 filed Dec. 17, 2014, which is incorporated herein by reference in entirety.

FIELD

The present disclosure relates to propulsion systems for marine vessels and more particularly to systems and methods for mounting a propulsion device with respect to a marine vessel.

BACKGROUND

The following U.S. Patents are incorporated herein by reference in entirety:

U.S. Pat. No. 9,481,434 discloses a mid-section housing for an outboard motor that includes a driveshaft housing having an oil sump. An adapter plate is coupled to a top of the driveshaft housing. The adapter plate has an inner surface along which oil from an engine mounted on the adapter plate drains into the oil sump. First and second pockets are formed in an outer surface of the adapter plate on first and second generally opposite sides thereof, the first and second pockets configured to receive first and second mounts therein. A water jacket is formed between the inner and outer surfaces of the adapter plate. The water jacket extends at least partway between the inner surface of the adapter plate and each of the first and second pockets, respectively.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions.

U.S. Pat. No. 7,896,304 discloses a support system for an outboard motor. The support system has mounts which are configured and positioned to result in an elastic center point being located closely to a roll axis of the outboard motor which is generally vertical and extends through a center of gravity of the outboard motor. The mounts are positioned so that lines which are perpendicular to their respective center lines intersect at an angle which can be generally equal to ninety degrees. The mounts are positioned in non-interfering relationship with the exhaust components of the outboard motor and its oil sump.

U.S. Pat. No. 7,244,152 discloses an adapter system as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

U.S. Pat. No. 6,942,530 discloses an engine control strategy for a marine propulsion system that selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

U.S. Pat. No. 6,929,518 discloses a shifting apparatus for a propulsion device that incorporates a magneto-elastic elastic sensor which responds to torque exerted on the shift shaft of the gear shift mechanism. The torque on the shift shaft induces stress which changes the magnetic characteristics of the shift shaft material and, in turn, allows the magneto-elastic sensor to provide appropriate output signals representative of the torque exerted on the shift shaft. This allows a microprocessor to respond to the onset of a shifting procedure rather than having to wait for actual physical movement of the components of the shifting device.

U.S. Pat. No. 6,419,534 discloses a support system for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with the driveshaft axis is not required, it has been determined that if the plane extending through the connectors is within forty-five degrees of perpendicularity with the driveshaft axis, improved vibration isolation can be achieved. A support structure, or support saddle, completely surrounds the engine system in the plane of the connectors. All of the support of the outboard motor is provided by the connectors within the plane, with no additional support provided at a lower position on the outboard motor driveshaft housing.

U.S. Pat. No. 6,322,404 discloses a Hall-Effect rotational position sensor mounted on a pivotable member of a marine propulsion system and a rotatable portion of the rotational position sensor attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus. A bus access manager, such as a CAN Kingdom network, is connected in signal communication with the controller to regulate the incorporation of additional devices to the plurality of devices in signal communication with the bus. The controller is connected in signal communication with each of the plurality of devices on the communication bus. The input and output devices can each transmit messages to the serial communication bus for receipt by other devices.

U.S. Pat. No. 4,893,800 discloses a power unit mount that includes a housing in which first and second electrode bodies are suspended and which is filled with a fluid which exhibits a change in viscosity when a voltage is applied there across. The control of the voltage application is determined by a control circuit which is operatively connected to a plurality of sensors which include an engine speed sensor, a road wheel speed sensor, a relative displacement sensor and an absolute displacement sensor. A variant includes a solenoid powered vibration generator which can be energized under predetermined conditions in a manner to improve vibration attenuation.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure arose during continuing research and development of mounts, mounting arrangements and methods of making mounting arrangements for supporting propulsion devices such as outboard motors with respect to marine vessels.

In certain examples, a system is for supporting a propulsion device with respect to a marine vessel. The system comprises an elastic mount configured to support the propulsion device with respect to the marine vessel. The elastic mount contains an electromagnetic fluid. An electromagnet is configured so that increasing an amount of electricity applied to the electromagnet increases the shear strength of the electromagnetic fluid in the elastic mount and thereby decreases elasticity of the elastic mount. The electromagnet is further configured so that decreasing the amount of electricity applied to the electromagnet decreases the shear strength of the electromagnetic fluid in the elastic mount and thereby increases the elasticity of the elastic mount. A controller is configured to automatically adapt the amount of electricity applied to the electromagnet during translation of the marine vessel so as to reduce the likelihood that the propulsion device impacts an adjacent structure on the marine vessel as a result of motion of the propulsion device caused by environmental forces including wind and waves. Corresponding methods are disclosed herein.

BRIEF DESCRIPTION OF THE DRAWINGS

The present disclosure is described with reference to the following figures. The same numbers are used throughout the figures to reference like features and like components.

DETAILED DESCRIPTION OF THE DRAWINGS

Figure 1:
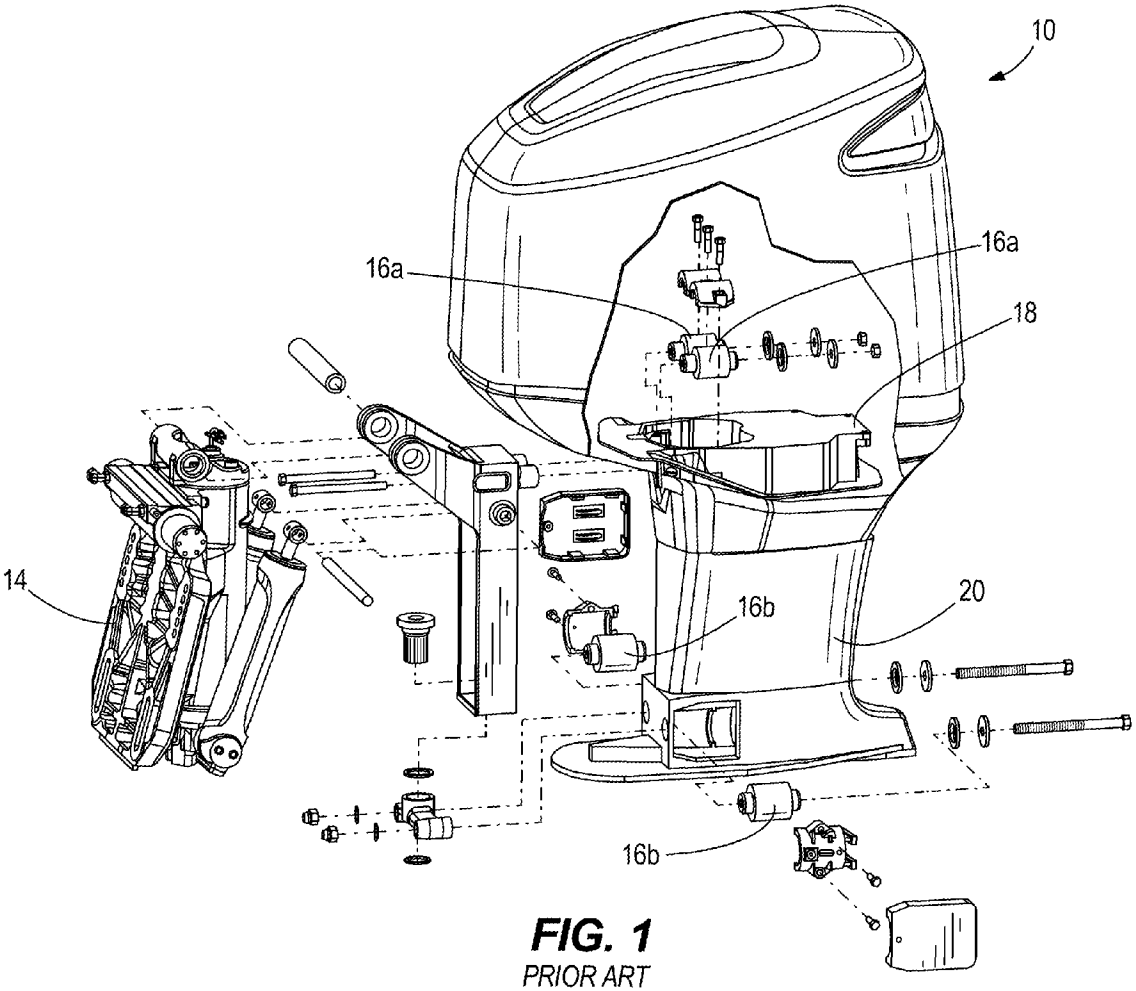
FIG. 1 PRIOR ART
FIG. 1 is taken from U.S. Pat. No. 7,244,152 and is a perspective view of a prior art propulsion device and prior art mounting devices for mounting the propulsion device to a marine vessel.

FIG. 1 is taken from the incorporated U.S. Pat. No. 7,244,152 and depicts an arrangement for mounting a propulsion device 10 to a marine vessel via a support bracket 14, which is commonly referred to in the art as a transom bracket. Details regarding the conventional transom bracket are provided in the '152 patent. As is conventional, a plurality of elastic mounts 16*a*-16*b* are disposed between connection points of the propulsion device 10 and marine vessel, including at an adapter plate 18 (see 16*a*) and at a drive shaft housing 20 (see 16*b*) of the propulsion device 10.

Through research and development, the present inventors have endeavored to provide propulsion systems for marine vessels having improved noise, vibration and harshness characteristics. Also, the present inventors have endeavored to provide a marine propulsion system having increased power, speed, and acceleration and tighter transom packaging. Through such research and development, the present inventors found that current elastomeric mounts have functional limitations that force engineering compromises regarding overall package size, layout, engine design, and noise, vibration and harshness characteristics. Also, the inventors found that prior art mounts typically are designed for an entire family of propulsion devices having similar characteristics and typically are not adjustable or vessel-specific. During research and development, the present inventors determined that it would be desirable to provide systems and methods that semi-actively and/or actively adapt the elasticity of the mounts based upon current characteristics and/or conditions of the propulsion device to thereby actively and/or semi-actively control displacement of the propulsion device during marine vessel travel.

Figure 2:
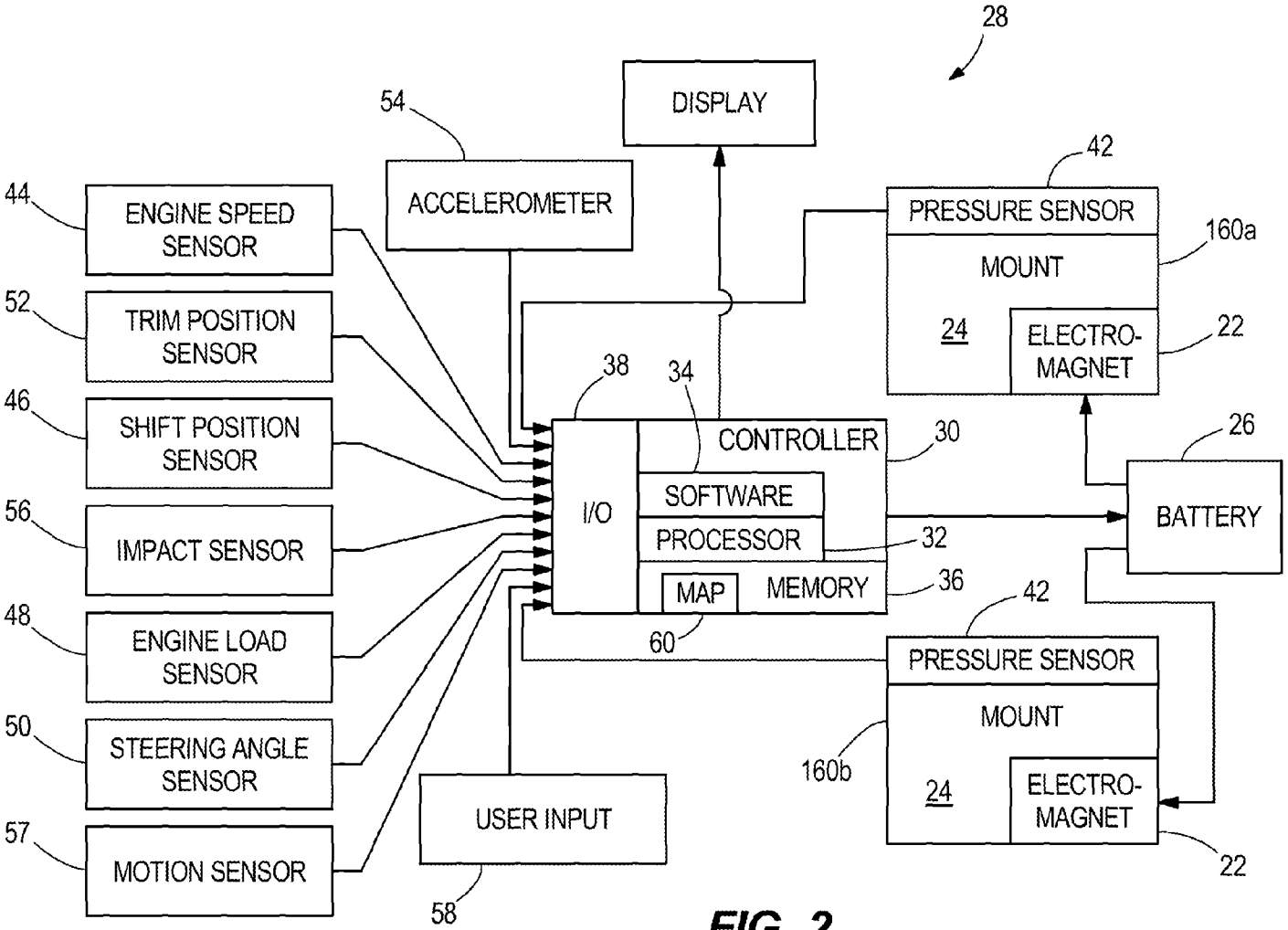
FIG. 2 is schematic depiction of a system according to the present disclosure for supporting a propulsion device with respect to a marine vessel.

FIG. 2 schematically depicts a system 28 according to the present disclosure for supporting the propulsion device 10 with respect to the marine vessel 12. The system 28 includes a controller 30 that is programmable and includes a computer processor 32, software 34, a memory (i.e., computer storage) 36 and an input/output (interface) device 38. The processor 32 loads and executes software 34, which can be stored in the memory 36. Executing the software 34 controls the system 28 to operate as described herein in further detail below. The processor 32 can comprise a microprocessor and/or other circuitry that receives and executes software 34. The processor 32 can be implemented within a single device, but can also be distributed across multiple processing devices and/or sub-systems that cooperate in executing program instructions. Examples include general purpose central processing units, application specific processors, and logic devices, as well as any other processing device, combinations of processing devices, and/or variations thereof. The controller 30 can be located anywhere with respect to the propulsion device 10 and marine vessel 12 and can communicate with various components of the system 28 via wired and/or wireless links. The controller 30 can have one or more microprocessors that are located together or remotely from each other in the system 28 or remotely from the system 28.

The memory 36 can include any storage media that is readable by the processor 32 and capable of storing software 34. The memory 36 can include volatile and/or nonvolatile, removable and/or non-removable media implemented in any method or technology for storage of information, such as computer readable instructions, data structures, program modules, or other data. The memory 36 can be implemented as a single storage device but may also be implemented across multiple storage devices or sub-systems. The memory 36 can further include additional elements, such as a controller capable of communicating with the processor 32. Examples of storage devices include random access memory, read only memory, magnetic discs, optical discs, flash memory discs, virtual and/or non-virtual memory, magnetic cassettes, magnetic tape, magnetic disc storage, or other magnetic storage devices, or any other medium which can be used to store the desired information and that may be accessed by an instruction execution system, as well as any combination or variation thereof, or any other type of storage media. In some implementations, the storage media can be a non-transitory storage media.

The input/output device 38 can include any one of a variety of conventional computer input/output interfaces for receiving electrical signals for input to the processor 32 and for sending electrical signals from the processor 32 to various components of the system 28.

The controller 30, via the input/output device 38, communicates with components of the propulsion device 10 via communication links, which as mentioned herein above can be wired or wireless links. As explained further herein below, the controller 30 is capable of monitoring and controlling operational characteristics of the propulsion device 10 by sending and/or receiving control signals via the various links shown in FIG. 2. Although the links are each shown as a single link, the term "link" can encompass one or a plurality of links that are each connected to one or more of the components of the system 28.

Mounts 160*a*, 160*b* are provided with an electromagnet 22. Each mount 160*a*, 160*b* contains an electromagnetic fluid 24. In this example, the electromagnet 22 is located in the respective mount 160*a*, 160*b*; however as will be evident from the examples below, the electromagnet 22 can alternately be located remote from the respective mount 160*a*, 160*b*. A power source 26, which can be a conventional battery or any other suitable power source, is configured to provide an amount of electricity (e.g., voltage, current) to the electromagnet 22. As described further herein below with respect to FIGS. 6-14, increasing the amount of electricity provided to the electromagnet 22 increases the shear strength of the electromagnetic fluid 24, thereby decreasing elasticity of the mount 160*a*, 160*b*. Decreasing the amount of electricity provided to the electromagnet 22 decreases the shear strength of the electromagnetic fluid 24, thereby increasing the elasticity of the mount 160*a*, 160*b*. Thus, changing the amount of electricity provided to the electromagnet 22 changes the damping characteristics of the mount 160*a*, 160*b*. This concept will become more apparent in view of the examples provided herein below with respect to FIGS. 6-14. Generally, application of a electricity across an electromagnetic fluid to alter damping characteristics of a suspension device is described, for example, in U.S. Pat. No. 4,893,800, which is incorporated herein by reference.

A pressure sensor 42 is connected to each mount 160*a*, 160*b* and is configured to sense the pressure of the electromagnetic fluid 24 in the mount 160*a*, 160*b* and communicate this information to the controller 30. The type and packaging of pressure sensor 42 can vary and in some examples includes a conventional pressure transducer.

An engine speed sensor 44 is configured to sense a current engine speed of the propulsion device 10. In certain examples, the engine speed sensor 44 senses rotations per minute (RPM) of the engine. The type and location of engine speed sensor 44 can vary and in one example is a Hall Effect or variable reluctance sensor located near the encoder ring of the engine. Such an engine speed sensor 44 is known in the art and commercially available, for example, from CTS Corporation or Delphi.

A shift position sensor 46 is configured to sense a current gear state (e.g. position) of a transmission associated with the propulsion device 10. In some examples the shift position sensor 46 senses a current position of a shift linkage associated with a conventional shift/throttle lever. The gear state that is sensed by the shift position sensor 46 is communicated to the controller 30. The type and location of shift position sensor 46 can vary. In one example, the shift position sensor 46 includes a potentiometer and an electronic converter, such as an analog to digital converter that outputs discrete analog to digital (ADC) counts that each represents a position of the noted shift linkage. Such potentiometer and electronic converter combinations are known in the art and commercially available, for example, from CTS Corporation.

An engine load sensor 48 is configured to sense a current engine load of the propulsion device 10 and communicate this information to the controller 30. The type of engine load sensor 48 can vary. In certain examples, the engine load sensor 48 is provided by the noted engine speed sensor 44 in combination with a throttle valve position sensor that senses position of a throttle valve associated with the engine on the propulsion device 10. The type of throttle position sensor can vary. One example of a throttle position sensor can be a wiper-type sensor, which can be located on the body of the noted throttle valve and is commercially available from Cooper Auto or Walbro. Engine load can thus be provided to controller 30 via comparison of the outputs of the noted throttle position sensor and the engine speed sensor 44.

A steering angle sensor 50 is configured to sense a current steering angle of the propulsion device 10 with respect to the marine vessel and provide this information to the controller 30. The type of steering angle sensor 50 can vary. In certain examples, the steering angle sensor 50 can include an encoder mounted on along a vertical steering axis of the propulsion device 10, as is conventional.

A trim position sensor 52 is configured to sense a current trim position of the propulsion device 10 and provide this information to the controller 30. The type of trim position sensor 52 can vary. In certain examples, the trim position sensor 52 includes an encoder positioned along a trim axis of the propulsion device 10.

An accelerometer 54 is configured to measure acceleration of the marine vessel and provides this information to the controller 30. In one example, the accelerometer includes a conventional gyroscope fixed to the propulsion device 10. Another accelerometer could be mounted to the marine vessel, if necessary.

An underwater impact sensor 56 is provided for sensing a future impact to the propulsion device 10 and communicating this information to the controller 30. They type of impact sensor 56 can vary and can include, for example, a sonar system, laser system, and/or the like.

A motion sensor 57 is configured to sense motion of the propulsion device 10 with respect to the marine vessel, for example vibration of the propulsion device 10 caused by environmental forces including wind and/or waves. The motion sensor 57 can be mounted on the propulsion device 10. The type of motion sensor 57 can vary and can include a global navigation satellite device with an internal measurement unit that collects angular velocity and linear acceleration, which data is sent to the controller 30. This type of motion sensor is well known in the art, an example is commercial available from XSENS, Product No. MTi-G-710.

The system 28 also includes a user input device 58 for inputting user commands to the controller 30. The user input device 58 can include a combination shift/throttle lever, a steering wheel, and/or a joystick. Other types of input devices such as a button, switch, touchscreen, and/or the like can also be used in addition to or instead of these conventional devices.

Advantageously, as described further herein below, the controller 30 is programmed to actively and automatically adapt the amount of electricity that is supplied to the electromagnets 22 from the power source 26 based upon one or more conditions of the system 28. In some examples, the memory stores one or more thresholds to which the controller 30 compares current sensed values and then controls the amount of electricity accordingly. In some examples, the memory 36 stores a map 60 that correlates the noted one or more conditions of the system 28 to the amount of electricity. The controller 30 is configured to follow the map 60 to apply a programmed amount of e electricity based upon current sensed values. In addition or alternately, the memory 36 stores a protocol that is followed by the controller 30 to thereby adapt the amount of electricity. In other words, the controller 30 is programmed to control the power source 26 to change the amount of electricity according to the map 60 and/or other protocol stored in the memory. The type of conditions upon which the controller 30 adapts the amount of electricity can vary and in some examples the controller 30 can be programmed to adapt the amount of electricity based upon more than one condition considered in combination. The conditions upon which the controller 30 adapts the amount of electricity can include characteristics of the propulsion device 10 and/or marine vessel. These conditions typically do not vary and can be calibrated in the controller 30 during setup of the system. The conditions upon which the controller 30 adapts the amount of electricity can include operational characteristics of the marine vessel, including speed, acceleration, steering angle, motion and/or the like. The controller 30 can be configured to adapt the amount of electricity upon the occurrence of one or more of these types of operational characteristics (i.e. in real-time), as further described herein below.

In some examples, the condition of the system upon which the controller 30 adapts the amount of electricity includes a pressure of the electromagnetic fluid 24 in the mount 160*a*, 160*b*. The pressure sensor 42 is configured to sense the pressure of the electromagnetic fluid 24 in the mount 160*a*, 160*b* and communicate this information to the controller 30, which compares the sensed pressure to the map 60 to thereby identify an amount of electricity to be applied to the electromagnet 22. Thereafter, the controller 30 controls the power source 26 to apply that amount of electricity. In some examples, the controller 30 can be configured to decrease the amount of electricity when the pressure of the electromagnetic fluid 24 exceeds a pressure threshold that is calibrated and stored in the memory 36. The controller 30 can be programmed to compare the pressure of the electromagnetic fluid 24, as sensed by the pressure sensor 42, to the stored pressure threshold, and thereafter control the power source 26 to decrease the amount of electricity when the pressure of the electromagnetic fluid 24 exceeds the pressure threshold. Thus this feature can protect the mount 160*a*, 160*b* from over pressure.

The controller 30 can also be programmed to alert an operator of the marine vessel that the propulsion device 10 is experiencing high static loading, for example due to rough water and/or high speed operations. In some examples, the controller 30 can be programmed to store this information in the memory 36 for service and/or warranty purposes. This feature can also actively monitor and adjust the amount of electricity during travel of the marine vessel according to the map 60 and/or another protocol saved in the memory 36, thus providing the system 28 with ride characteristics that are selected by the calibrator and/or the user.

In certain examples, the condition of the system can include a current gear state of the propulsion device 10. In these examples, the shift position sensor 46 is configured to sense the current gear state of the propulsion device 10 and communicate this information to the controller 30. Based upon this information, the controller 30 is configured to control the power source 26 to apply an appropriate amount of electricity to the electromagnet 22, as determined for example by the map 60 and/or another protocol saved in the memory 36. For example, it can be desirable to limit displacement of the propulsion device 10 during forward and/or reverse gear state of propulsion device 10 to provide certain ride characteristics, while it can also be desirable to allow displacement of the propulsion device 10 during neutral gear state of the propulsion device to limit noise, vibration and/or harshness. In this non-limiting example, the controller 30 can be programmed to increase the amount of electricity during forward and reverse gear states and decrease the amount of electricity during neutral gear state.

In certain examples, the condition of the system 28 includes a current trim position of the propulsion device 10. In these examples, the noted trim position sensor 52 is configured to sense the current trim position of the propulsion device 10 and communicate this information to the controller 30. Based upon this information, the controller 30 is programmed to control the power source 26 to apply a certain amount of electricity to the electromagnet 22, as determined for example by the map 60 or other protocol saved in memory 36. In certain examples, the controller 30 can be programmed to increase the amount of electricity when the current trim position of the propulsion device 10 exceeds a trim position threshold stored in the memory 36. In this non-limiting example, the controller 30 is capable of decreasing the resiliency of the mounts 160*a*, 160*b* when the propulsion device 10 is trimmed up, which typically happens when the marine vessel 12 is docked.

In certain examples, the condition of the system 28 can include a future or predicted impact to the propulsion device 10. In these examples the impact sensor 56 is configured to sense the future or predicted impact to the propulsion device 10 and communicate this information to the controller 30. Based upon this information, the controller 30 is programmed to control the power source 26 to adapt the amount of electricity. In some non-limiting examples, the controller 30 can be programmed to decrease the amount of electricity when an impact to the propulsion device 10 is predicted, thus allowing the propulsion device 10 to deflect when hit. This can protect the propulsion device 10 from being damaged.

In certain examples, the condition of the system 28 can include a current engine load of the propulsion device 10. In these examples, the engine load sensor 48 is configured to sense the current engine load of the propulsion device 10 and communicate this information to the controller 30. The controller 30 is configured to control the power source 26 to adapt the amount of electricity based upon, for example, the noted map 60 or other protocol saved in the memory 36. The controller 30 thus advantageously can be calibrated to adjust the ride characteristics of the propulsion device 10 during translation of the marine vessel 12.

In some examples, the condition of the system 28 can include the current engine speed of the propulsion device 10. In these examples, the engine speed sensor 44 is configured to sense the current engine speed of the propulsion device 10 and communicate this information to the controller 30, which in turn is configured to control the power source 26 based upon, for example the protocol set forth in the map 60 stored in the memory 36. In some examples, the controller 30 is programmed to decrease the amount of electricity when the current engine speed is below an engine speed threshold saved in the memory 36. In certain examples, the controller 30 is configured to increase the amount of electricity when the current engine speed is above an engine speed threshold stored in the memory 36. The controller 30 thus advantageously can be calibrated to adjust the ride characteristics of the propulsion device 10 during translation of the marine vessel 12.

In certain examples, the condition of the system 28 can include a current steering angle of the propulsion device 10. In these examples, the steering angle sensor 50 is configured to sense the current steering angle and communicate this information to the controller 30. In turn, the controller 30 is configured to control the power source 26 to control the amount of electricity applied to the electromagnet 22. In some examples, the controller 30 is configured to increase the amount of electricity when the current steering angle of the propulsion device 10 is outside of a stored range.

In certain examples, the condition of the system 28 includes and off-state of an internal combustion engine associated with the propulsion device 10. In these examples, the controller 30 can be programmed to increase the amount of electricity to lock the mount 160*a*, 160*b* in position when the off state of the engine occurs.

As shown in FIG. 2, the system 28 can further include the user input device 58 for inputting a desired state of elasticity of the mount 160*a*, 160*b*. In these examples, the controller 30 can be configured to adapt the amount of electricity to achieve the desired state of elasticity of the mount 160*a*, 160*b*, as for example according to the map 60 or other protocol saved in the memory 36. The controller 30 can also be configured to control a display device 63 for displaying the condition of the mount 160*a*, 160*b* to an operator of the system 28.

Figure 3:
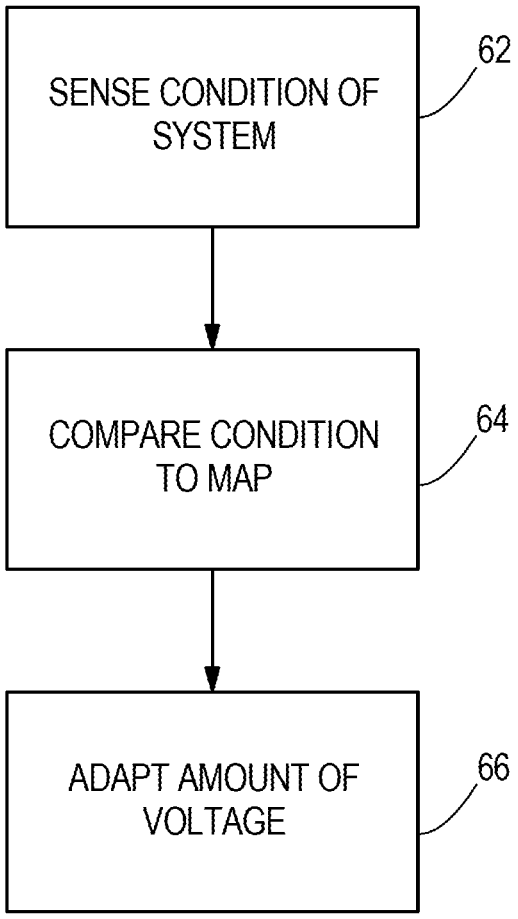
FIGS. 3-5 are flow charts depicting exemplary methods according to the present disclosure.
Figure 4:
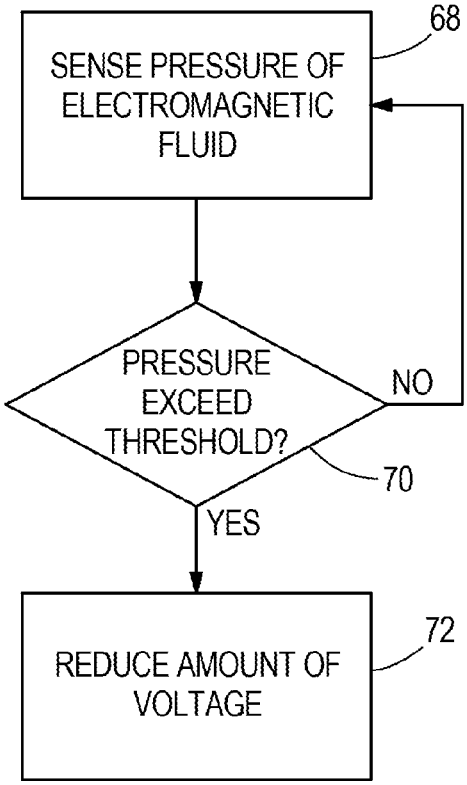
Figure 5:
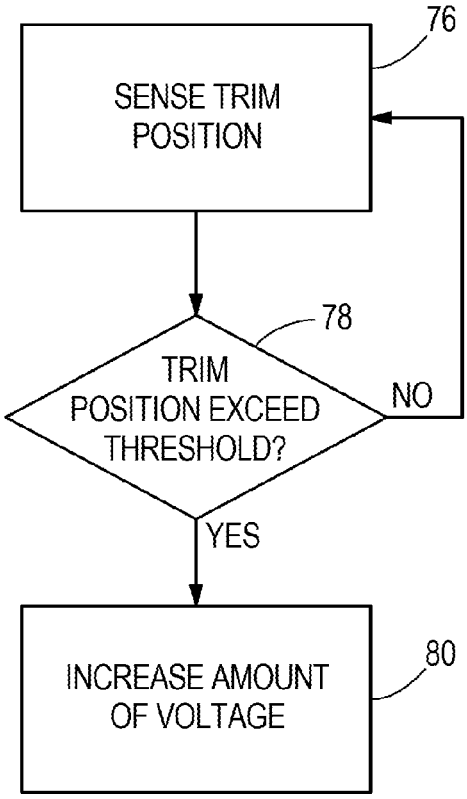

FIGS. 3-5 depict non-limiting exemplary methods according to the present disclosure.

As shown in FIG. 3, at step 62, one or more of the above noted sensors is configured to sense one or more conditions of the system 28 and communicate this information to controller 30. At step 64, the controller 30 is configured to compare the sensed condition(s) to the map 60 or to another protocol stored in the memory 36. At step 66, the controller 30 is configured to adapt the amount of electricity that is applied by the power source 26 to the electromagnet 22.

FIG. 4 depicts an example wherein the pressure sensor 42 is utilized to sense pressure of electromagnetic fluid 24 in the electromagnet 22, at step 68. At step 70, the controller 30 is configured to compare the pressure of the electromagnetic fluid 24 to a pressure threshold that is stored in the memory 36. If the pressure exceeds the pressure threshold, at step 72, the controller 30 is programmed to control the power source 26 to reduce the amount of electricity that is applied to the electromagnet 22.

In FIG. 5, at step 76, the trim position sensor 52 senses the trim position of the propulsion device 10 with respect to the marine vessel 12. At step 78, the controller 30 is configured to compare the trim position that is sensed by the trim position sensor 52 to a threshold that is stored in the memory 36. If the trim position exceeds the threshold, the controller 30 is configured to control the power source 26 at step 80 to increase the amount of electricity applied to the electromagnet 22.

In certain examples, the map 60 can correlate trim and steering positions for specific tight transom installations, having limited space for movement of the propulsion device 10. The map 60 can dictate "pinch" points where the amount of electricity needs to be adjusted to minimize deflection of the mounts 160*a*, 160*b* and thus prevent cowl collision.

In other examples, the controller 30 can actively monitor for high internal mount pressure and/or motion, and adjust the amount of electricity during travel of the marine vessel, providing restriction on the amount of deflection of the mounts 160*a*, 160*b* to prevent cowl collision in tightly packaged transom arrangements.

In other words, the system 28 can be configured to allow tightly packed transom arrangements, while still accomplishing functional goals such as power, speed and acceleration. The inventors have recognized that it is desirable to provide marine propulsion systems having increased power, speed, and acceleration; however this often requires the designer to add larger propulsion devices and/or multiple propulsion devices to the system. As stated above, the inventors have also recognized that it is desirable to provide marine propulsion systems having a smaller footprint, i.e. smaller package size, design and/or layout. These interests compete with each other and thus present design challenges. The larger the size and/or number of propulsion devices, the greater the power, speed and acceleration. However when larger propulsion devices and/or multiple propulsion devices are added, it becomes difficult to meet small package size, design and layout requirements.

During operation of a marine propulsion system, environmental forces on the marine propulsion devices, such as wind and/or waves, will normally cause the marine propulsion devices to vibrate and/or otherwise move with respect to surrounding structures, such as the hull of marine vessel and/or adjacent marine propulsion devices on the transom. Also, each marine propulsion device is typically steerable about a steering axis between port and starboard orientations. As such, for every marine propulsion system layout, there is a minimum amount of spacing required between the propulsion device and adjacent structures. That is, the designer must include enough space between each propulsion device on the transom to accommodate the above-mentioned vibration and steering movements, and specifically to avoid collision between the propulsion device and adjacent structures.

Through research and experimentation, the present inventors have determined that it is possible to utilize the above-described systems to achieve higher performance with tighter tolerances, i.e., packaging the propulsion devices with less surrounding space. More specifically, the present inventors have realized that the amount of spacing that is actually required in the marine propulsion system layout varies depending upon the operating condition of the system. For example, when the marine propulsion system is inoperative or operating at idle and/or at relatively low speeds, minimal environmental forces will typically impact the propulsion device and thus only a relatively small amount of spacing is normally required to accommodate vibration or other movements caused by environmental forces. On the other hand, when the marine propulsion system is operating at relatively high speeds, it often will encounter more forceful environmental forces, such as high wind and/or waves, and thus a relatively large amount of spacing is required to prevent collision between the propulsion device and adjacent structures. Other factors, such as the steering angle of the propulsion device will also impact the necessary spacing between the propulsion device and adjacent structures. When the propulsion device is in a straight-ahead orientation, environmental forces are less likely to cause movement of the propulsion device and adjacent structures. On the other hand, when the propulsion device is steered into an extreme turning orientation, it will move closer to adjacent structures, thus making it more likely that environmental forces will cause movements of the propulsion device that result in a collision with the adjacent structure.

Based upon these realizations, the present inventors invented the presently disclosed systems and methods, which automatically adapt the amount of electricity applied to the electromagnet during operation (e.g. translation) of the marine vessel—so as to reduce the likelihood that the propulsion device impacts an adjacent structure on the marine vessel as a result of motion of the propulsion device caused by environmental forces including wind and waves. Further examples are provided herein below.

In some examples, the controller 30 is programmed to automatically adapt the amount of electricity applied to the electromagnet 22 during operation of the marine vessel so as to reduce the above-described likelihood that the propulsion device 10 impacts an adjacent structure on the marine vessel as a result of motion of the propulsion device 10 caused by environmental forces including wind and waves. The "adjacent structure" can be another propulsion device 10 on the marine vessel and/or the hull of the marine vessel itself and/or any other adjacent structure. The controller 30 is configured to automatically increase the amount of electricity applied to the electromagnet 22 when it determines that the propulsion device 10 has become more likely to impact the adjacent structure. The controller 30 is further programmed to automatically decrease the amount of electricity applied to the electromagnet 22 when it determines that the propulsion device 10 has become less likely to impact the adjacent structure. The way in which the controller 30 determines the likelihood of impact to the propulsion device 10 can vary. In some examples, the controller 30 is programmed to determine whether the propulsion device 10 has become more or less likely to impact the adjacent structure based at least in part upon the present steering angle of the propulsion device 10. In this example, the controller 30 is programmed to increase the amount of electricity applied to the electromagnet 22 when the present steering angle becomes greater than (i.e. further away from a straight-ahead orientation) a threshold steering angle value stored in the memory 36. The controller 30 is further programmed to decrease the amount of electricity applied to the electromagnet 22 when the present steering angle becomes less than (i.e. closer to the straight-ahead orientation) the threshold steering angle value stored in the memory 36. The threshold steering angle is a value that can be calibrated by the engine designer through trial and error or based on historical data for the same or similar layouts.

In some examples, the controller 30 is programmed to determine whether the propulsion device 10 has become more or less likely to impact the adjacent structure based at least in part upon a present motion characteristic of the propulsion device with respect to the marine vessel. In this example, the controller 30 is programmed to increase the amount of electricity applied to the electromagnet 22 when the present motion (e.g. vibration) of the propulsion device 10 becomes greater than a threshold motion value stored in the memory 36. The controller 30 is further programmed to decrease the amount of electricity applied to the electromagnet 22 when the present motion (e.g. vibration) of the propulsion device 10 becomes less than the threshold motion value stored in the memory 36. The threshold motion value is a value that can be calibrated by the engine designer through trial and error or based on historical data for the same or similar layouts.

In some examples, the controller 30 is programmed to determine whether the propulsion device 10 has become more or less likely to impact the adjacent structure based at least in part upon the present speed of the engine. In this example, the controller 30 is configured to increase the amount of electricity applied to the electromagnet 22 when the present speed of the engine becomes greater than a threshold engine speed value stored in the memory 36. The controller 30 is configured to decrease the amount of electricity applied to the electromagnet 22 when the present speed of the engine becomes less than the threshold engine speed value stored in the memory 36. The threshold engine speed value is a value that can be calibrated by the engine designer through trial and error or based on historical data for the same or similar layouts. Similar to these examples, in other examples, the controller 30 can be programmed to determine whether the propulsion device 10 has become more or less likely to impact the adjacent structure based at least in part upon the present engine load, i.e. how the present engine load compares to a threshold engine load stored in the memory 36.

In some examples, the controller 30 is programmed to determine whether the propulsion device 10 has become more or less likely to impact the adjacent structure based at least in part upon the state of acceleration of the propulsion device 10. In this example, the controller 30 is programmed to increase the amount of electricity applied to the electromagnet 22 when the present state of acceleration of the propulsion device 10 becomes greater than a threshold acceleration value stored in the memory 36. The controller 30 is configured to decrease the amount of electricity applied to the electromagnet 22 when the present state of acceleration of the propulsion device 10 becomes less than the threshold acceleration value stored in the memory 36. The threshold acceleration value is a value that can be calibrated by the engine designer through trial and error or based on historical data for the same or similar layouts.

In some examples, the controller 30 is programmed to determine whether the propulsion device 10 has become more or less likely to impact the adjacent structure based at least in part upon the present trim position of the propulsion device 10. In this example, the controller 30 is programmed to increase the amount of electricity applied to the electromagnet 22 when the present trim position of the propulsion device 10 becomes greater than a threshold trim position value stored in the memory 36. The controller 30 is configured to decrease the amount of electricity applied to the electromagnet 22 when the present trim position of the propulsion device 10 becomes less than the threshold trim position value stored in the memory 36. The threshold trim position value is a value that can be calibrated by the engine designer through trial and error or based on historical data for the same or similar layouts.

In some examples, the controller 30 is programmed to operate based on any combination of the above-mentioned values. For example, the controller 30 can be programmed to determine the likelihood that the propulsion device 10 impacts the adjacent structure on the marine vessel based at least in part on a combination of the present speed of an engine associated with the propulsion device 10 and the present motion of the propulsion device 10 with respect to the marine vessel. For example, the map 60 stored in the memory 36 can correlate speed of the engine and motion of the propulsion device 10 with respect to the marine vessel to an amount of electricity applied to the electromagnet 22. Based on the present speed of the engine and motion of the propulsion device 10, the map 60 will inform the controller 30 regarding the likelihood that the propulsion device 10 impacts the adjacent structure on the marine vessel. The controller 30 can thus be programmed to control the power source 26 in accordance with the map 60. The values of the map 60 can be calibrated by the engine designer through trial and error or based on historical data for the same or similar layouts.

In other examples, the controller 30 can be programmed to determine the likelihood that the propulsion device 10 impacts the adjacent structure on the marine vessel based at least in part on a combination of the present speed of an engine associated with the propulsion device 10 and a present steering angle of the propulsion device 10. In this example, the map 60 stored in the memory 36 correlates speed of the engine and steering angle of the propulsion device 10 to an amount of electricity applied to the electromagnet 22. Based on the present speed of the engine and present steering angle of the propulsion device 10, the map 60 will inform the controller 30 regarding the likelihood that the propulsion device 10 impacts the adjacent structure on the marine vessel. The controller 30 can thus be programmed to control the power source 26 in accordance with the map 60. The values of the map 60 can be calibrated by the engine designer through trial and error or based on historical data for the same or similar layouts.

It will thus be recognized that the present disclosure provides methods for supporting a propulsion device 10 with respect to a marine vessel. The methods can include (1) providing an elastic mount 160*a*, 160*b* that supports the propulsion device 10 with respect to the marine vessel; (2) configuring an electromagnet 22 so that increasing an amount of electricity applied to the electromagnet 22 increases the shear strength of an electromagnetic fluid 24 in the elastic mount 160*a*, 160*b* thereby decreasing elasticity of the elastic mount 160*a*, 160*b*, and so that decreasing the amount of electricity applied to the electromagnet 22 decreases the shear strength of the electromagnetic fluid 24 in the elastic mount 160*a*, 160*b* thereby increasing the elasticity of the elastic mount 160*a*, 160*b*; and (3) automatically adapting the amount of electricity applied to the electromagnet 22 during translation of the marine vessel so as to reduce a likelihood that the propulsion device 10 impacts an adjacent structure on the marine vessel as a result of motion of the propulsion device 10 caused by environmental forces including wind and waves. The methods can further include (4) increasing the amount of electricity applied to the electromagnet 22 when the propulsion device 10 becomes more likely to impact the adjacent structure and decreasing the amount of electricity applied to the electromagnet 22 when the propulsion device 10 has become less likely to impact the adjacent structure.

According to some examples, the methods include determining the likelihood that the propulsion device 10 impacts the adjacent structure on the marine vessel based at least in part on a present speed of an engine associated with the propulsion device 10 and a present motion of the propulsion device 10 with respect to the marine vessel. According to some examples, the methods include determining the likelihood that the propulsion device 10 impacts the adjacent structure on the marine vessel based at least in part on a present speed of an engine associated with the propulsion device 10 and a present steering angle of the propulsion device 10.

FIGS. 6-14 depict examples of suitable mounts 260*a*-260*c* that can be substituted for one or more of the mounts 16*a*-16*b* shown in FIG. 1.

Figure 6:
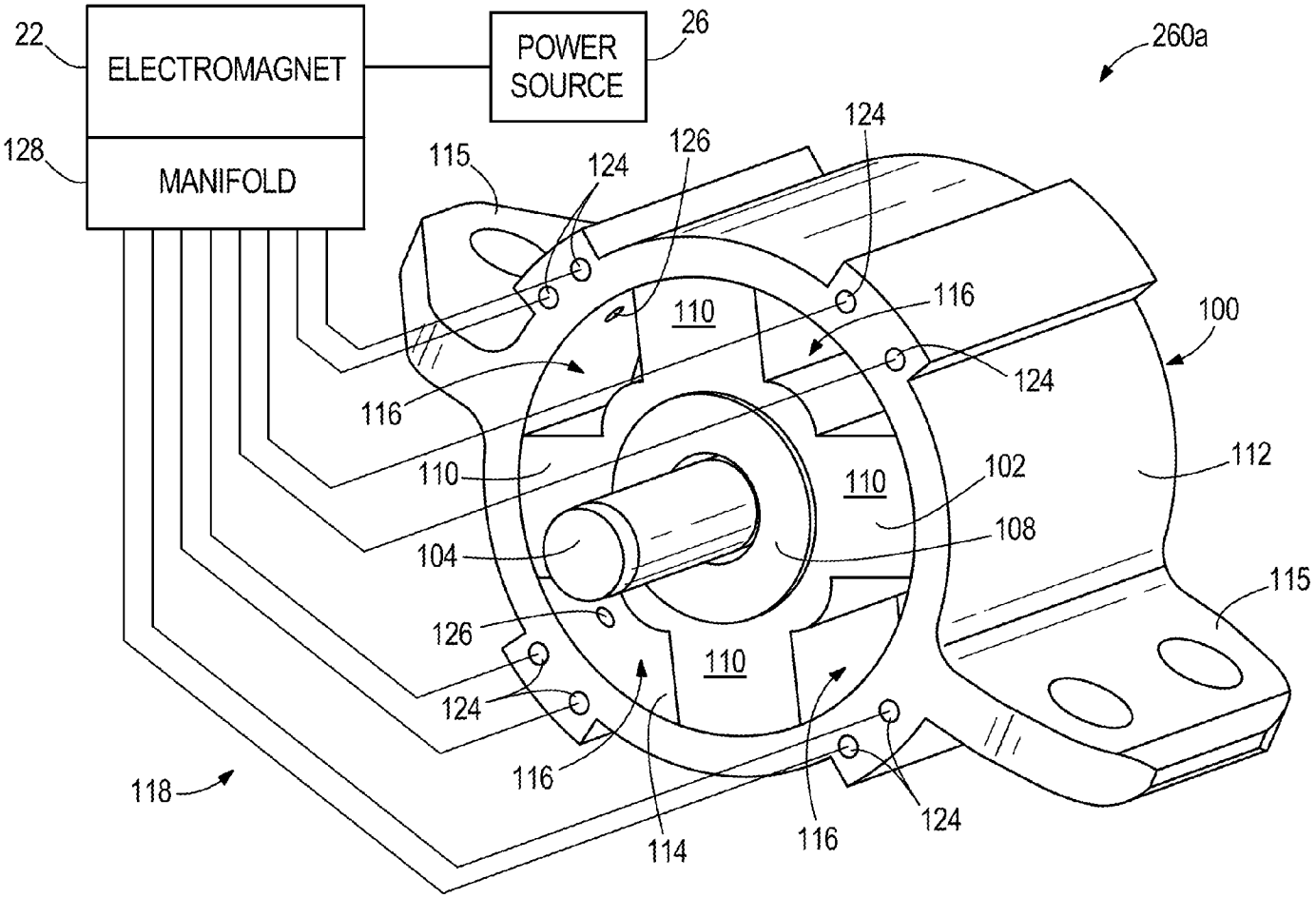
FIGS. 6-7 depict a first example of an elastic mount according to the present disclosure.
Figure 7:
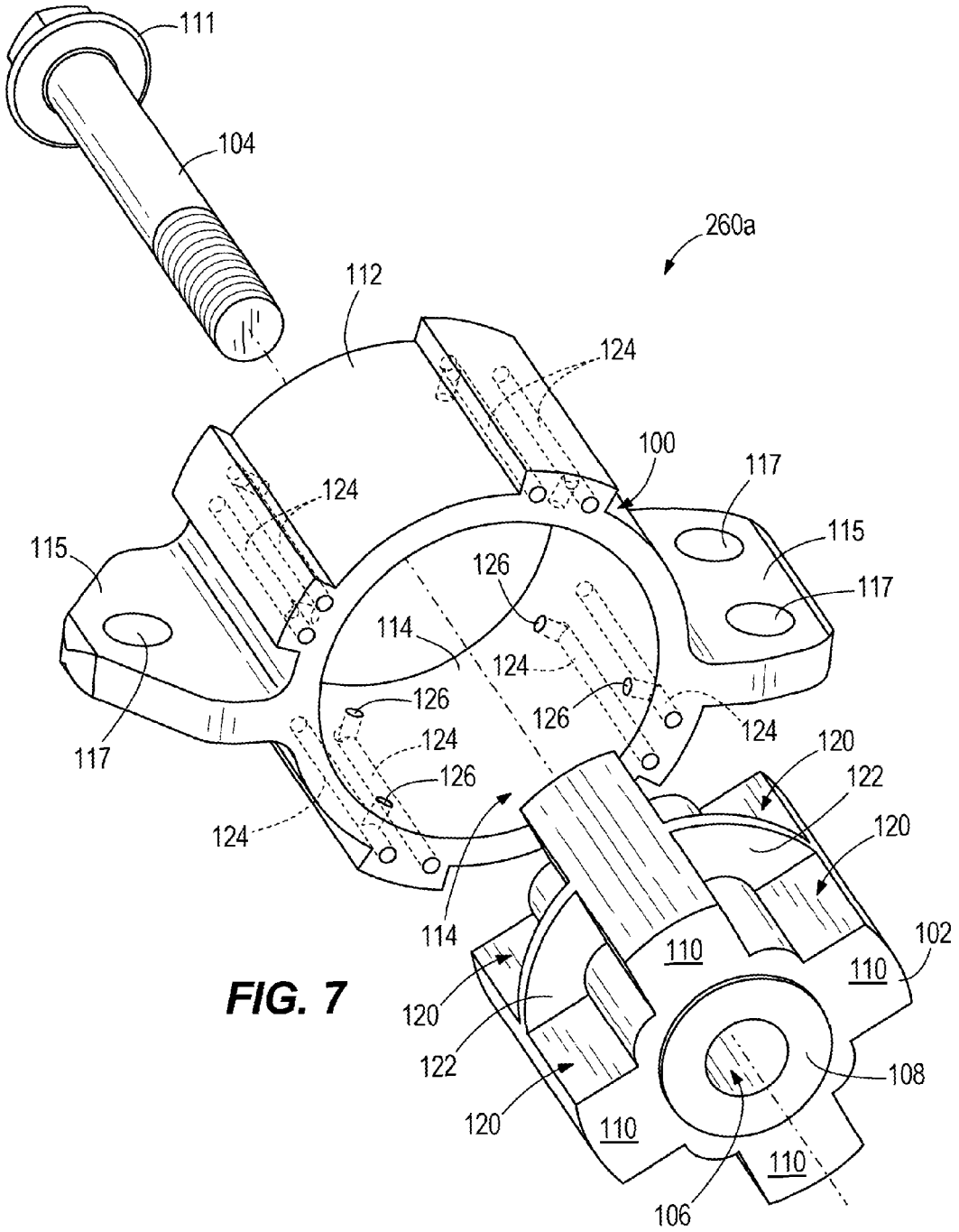
Figure 8:
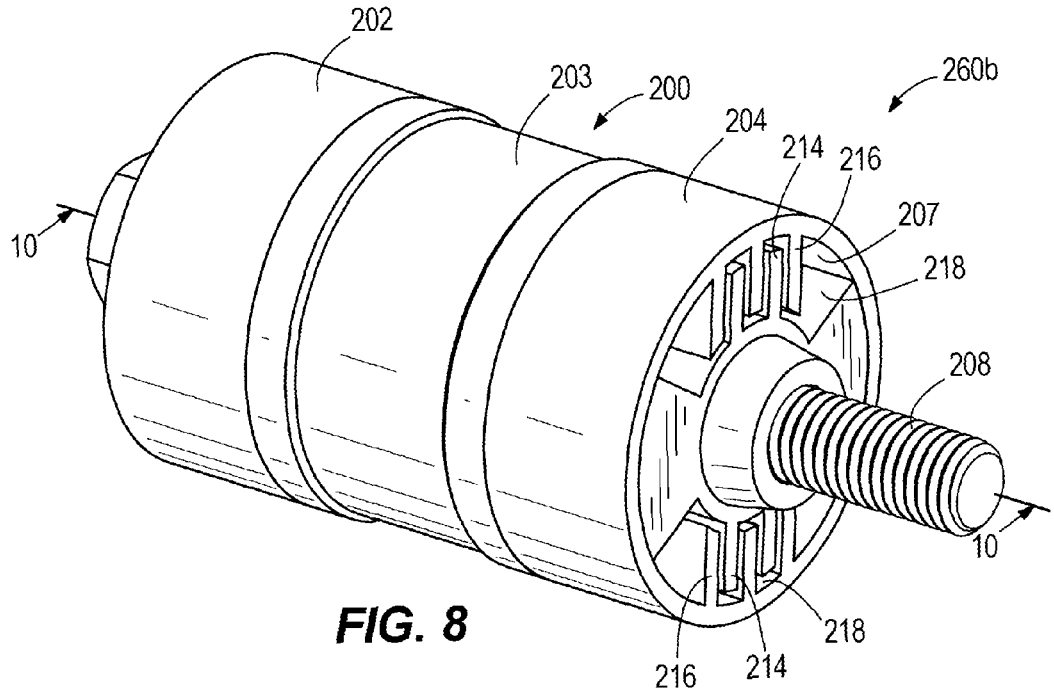
FIGS. 8-11 depict a second example of an elastic mount according to the present disclosure.
Figure 9:
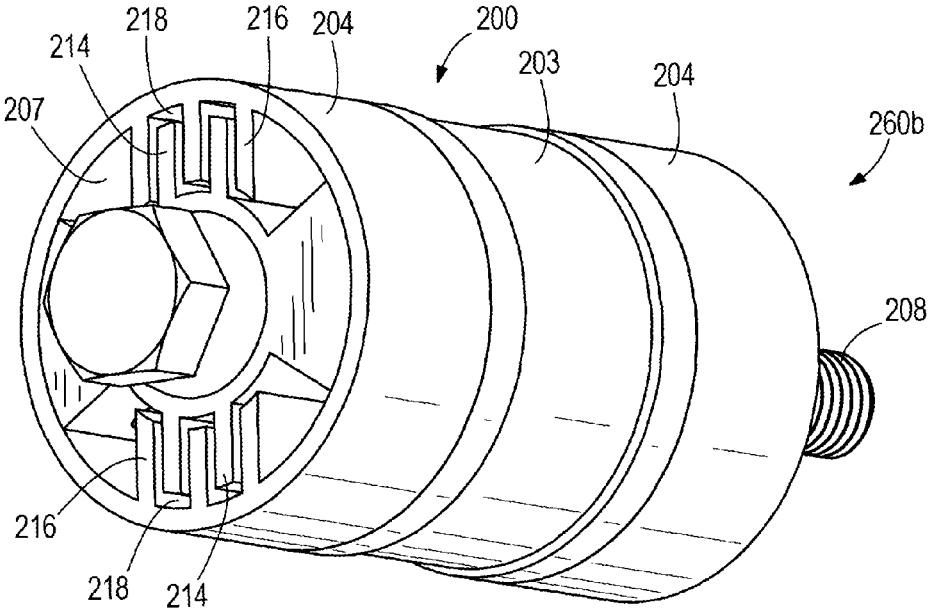
Figure 10:
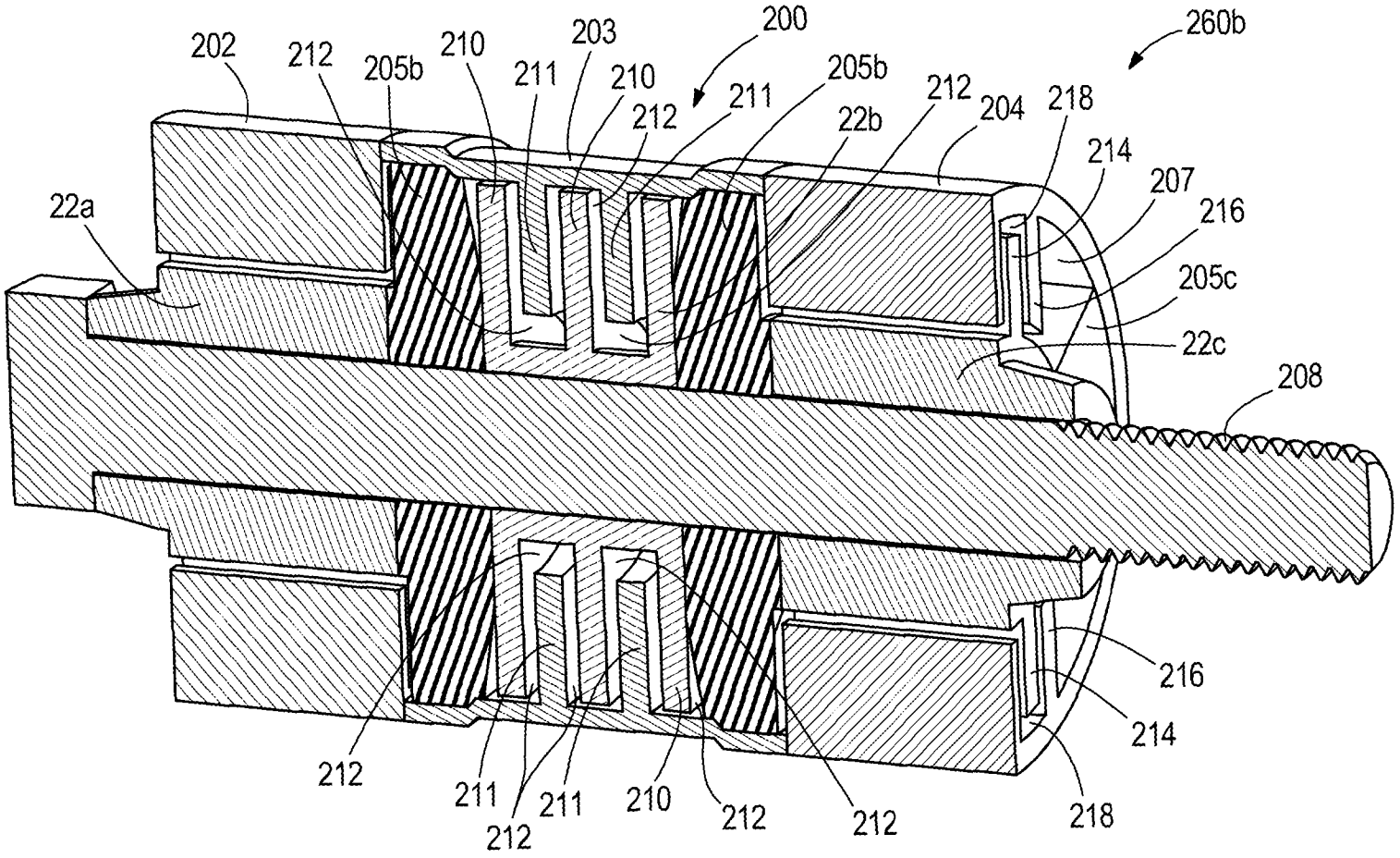
Figure 11:
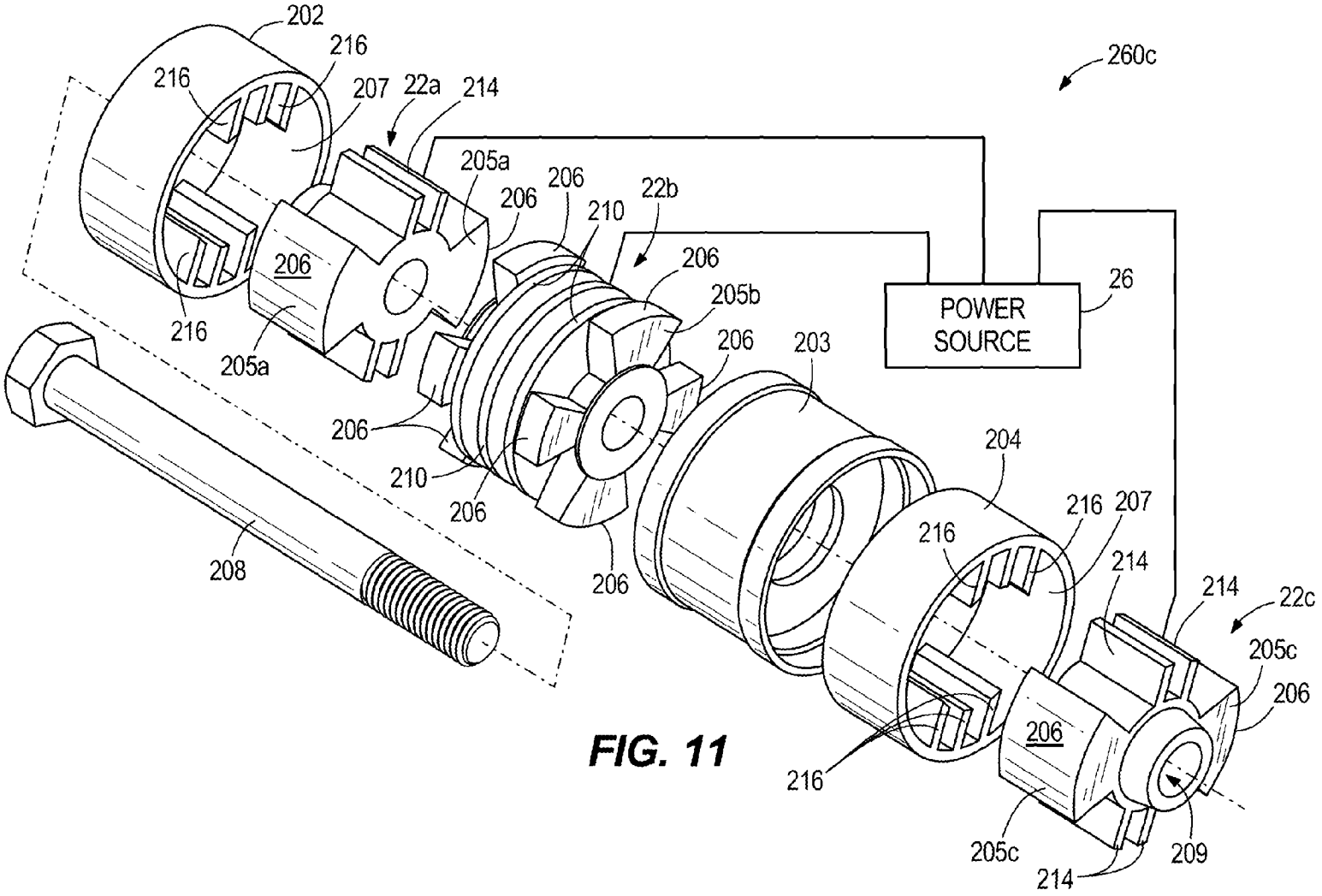

FIGS. 6 and 7 depict a first example of a mount 260*a* according to the present disclosure. The mount 260*a* is designed to replace the mounts 16*a* and/or 16*b* shown in FIG. 1, which are disposed between connection points of the propulsion device 10 and marine vessel, including for example at the adapter plate 18 and drive shaft housing 20 of the propulsion device 10.

In FIGS. 6 and 7, the mount 260*a* includes a housing 100, a resilient member 102 fixed to the housing 100 and an elongated connector 104 that extends though the resilient member 102. In the illustrated example, the elongated connector 104 is a bolt however the type and configuration of the elongated connector 104 can vary from what is shown. The elongated connector 104 extends through a throughbore 106 in a hub 108 of the resilient member 102 such that a head 111 on the elongated connector 104 is securely clamped against an axial end of the hub 108 when the elongated connector 104 is fastened to the propulsion device 10 in the manner shown in FIG. 1. In the illustrated example, the housing 100 has a cylinder 112 and opposing flanges 115 with holes 117 for receiving fasteners (not shown) to thereby fasten the housing 100 in place to the propulsion device 10. The clamp load produced by the connector 104 facilitates rotational (torque) loading within the mount 260*a*, all as is known in the art.

The resilient member 102 includes radially extending arms 110 that are radially spaced apart and fixed to an inner diameter 114 of the cylinder 112, for example by an adhesive or any other suitable form of fastening. The resilient member 102 is made of rubber or other suitable elastomeric material such that the resilient member 102 can bend/deflect with respect to the cylinder 112 under forces from the propulsion device 10 and/or marine vessel. A plurality of cavities 116 are defined between the inner diameter 114 of the cylinder 112 and the arms 110 of the resilient member 102. The cavities 116 are interdigitated amongst the plurality of arms 110. Each cavity contains electromagnetic fluid. The cavities 116 are further defined by (i.e. closed by) a not-shown covering and/or shell and/or axial end plate(s) on the cylinder 112. Any suitable covering, shell or axial end plate will suffice, as long as the covering, shell, and/or axial end plate(s) provides a fluid-tight seal on the axial ends of the cylinder 112 so as to enclose the cavities 116 and contain the electromagnetic fluid therein.

A fluid circuit 118 connects the cavities 116 to each other so that the electromagnetic fluid can flow into and between the cavities when the resilient member 102 is deformed under the external forces from the propulsion device and from the marine vessel. That is, bending or deforming of the resilient member 102 causes the geometry of each cavity 116 to change. In any given deformation, a first group of cavities 116 will decrease in size, forcing electromagnetic fluid out of those particular cavities 116. The remaining second group of cavities 116 will increase in size, creating a vacuum that allows inflow of electromagnetic fluid from the first group of cavities 116. The fluid circuit 118 facilitates the travel of electromagnetic fluid amongst the cavities 116.

The configuration of the fluid circuit 118 can vary from what is shown. As mentioned above, the cavities 116 are defined between adjacent pairs of arms 110. The fluid circuit 118 connects the respective cavities 116 so that the electromagnetic fluid is free to flow into and between the cavities 116 when the resilient member 102 is rotationally deformed under external forces from the propulsion device 10 or marine vessel.

Each cavity 116 has axially aligned sub-cavities 120 (see FIG. 7), which are separated from each other by a dividing wall 122. The fluid circuit 118 connects the axially aligned sub-cavities 120 of each cavity 116 with each other so that the electromagnetic fluid is free to flow into and between the axially aligned sub-cavities when the resilient member 102 is axially deformed by the connector 104 under external forces from the propulsion device or marine vessel.

In the illustrated example, the fluid circuit 118 comprises a plurality of fluid passages 124 in the cylinder 112. The fluid passages 124 are connected to radial holes 126 formed in the inner diameter 114 of the cylinder 112. At least one radial hole 126 is located in each of the sub-cavities 120, which allows flow of electromagnetic fluid into and between the respective cavities 116 and sub-cavities 120, as described above.

The fluid circuit 118 further includes a manifold 128 (see FIG. 6) that is remotely connected to each sub-cavity 120 via the above-described fluid passages 124 and radial holes 126. The configuration of the manifold 128 can vary and in some examples can include a conventional fluid accumulator to facilitate quick reaction to external forces on the mount 260*a* and/or a conventional inertia track device. The electromagnet 22 is coupled to the manifold 128. As described herein above, the electromagnet 22 is configured so that increasing the amount of electricity applied to the electromagnet 22 increases the shear strength of the electromagnetic fluid in the manifold 128, thereby decreasing elasticity of the mount 260*a*. That is, increasing the shear strength of the electromagnetic fluid causes the fluid to resist movement (flow) into and between the cavities 116 and sub-cavities 120 via the passages 124 and radial holes 126. This decreases the elasticity of the mount 260*a*. Decreasing the amount of electricity applied to the electromagnet 22 decreases the shear strength of the electromagnetic fluid in the mount 260*a* thereby increasing the elasticity of the mount 260*a*. That is, decreasing the shear strength of the electromagnetic fluid causes the fluid to more easily move (flow) into and between the cavities 116 and sub-cavities 120 via the passages 124 and radial holes 126. This increases the elasticity of the mount 260*a*.

In the configuration shown in FIGS. 6 and 7, the equally sized sub-cavities 120 allow for control over the mount's resistance to lateral/axial motion, as well as tipping motions. The four equally-sized cavities 116 allow for control over the mount's resistance to roll and vertical/horizontal translation motion.

FIGS. 8-11 depict a second example of a mount 260*b* according to the present disclosure. The mount 260*b* is designed to replace the mounts 16*a* and/or 16*b* shown in FIG. 1, which are disposed between connection points of the propulsion device 10 and marine vessel, including for example at the adapter plate 18 and drive shaft housing 20 of the propulsion device 10.

In FIGS. 8-11, the mount 260*b* has an elongated housing 200 formed from a plurality of housing sections 202, 203, 204 that are axially connected together. A plurality of electromagnets 22*a*, 22*b*, 22*c* are disposed in the elongated housing 200 and connected to a power source 26 (see FIG. 11) to receive electricity, as described herein above.

Resilient members 205*a*, 205*b*, 205*c* are disposed on the electromagnet 22 and have radially outer surfaces 206 that are fixed to the inner diameter 207 of the housing sections 202, 204 by an adhesive or any other suitable fastener. Although not shown, the interior of the housing 200 is enclosed by a covering and/or shell and/or axial end plate(s). As described herein above with respect to the example in FIGS. 6 and 7, the configuration of the covering, shell and/or axial end plate(s) can vary as long as the interior of the elongated housing 200 is sealed in a fluid tight manner to retain electromagnetic fluid therein.

The electromagnets 22*a*, 22*b*, 22*c* are disposed in the housing 200 and an elongated connector 208 extends through a through-bore 209 formed in the electromagnets 22*a*, 22*b*, 22*c*. As explained above, the clamp load produced by the connector 208 facilitates rotational (torque) loading within the mount 260*c*, all as is known in the art. The electromagnet 22*b* has a plurality of radial fins 210 are provided in the housing 200. A plurality of radial baffles 211 extends radially inwardly from the inner diameter 207 of the center-most housing section 203 and are interdigitated amongst the radial fins 210. When the resilient members 205*a*-205*c* are axially deformed via the connector 208 under external force from the propulsion device 10 or marine vessel, the electromagnetic fluid is caused to flow into and out of cavities 212 formed between the radial fins 210 and radial baffles 211, from cavity 212 to cavity 212, around the radial fins 210 and radial baffles 211. The shape and spacing of the radial fins 210 and radial baffles 211 defines the shape of the cavities 212 and the pathways for the flow of electromagnetic fluid.

The electromagnets 22*a*, 22*c* further include a plurality of axial fins 214. A plurality of axial baffles 216 extends radially inwardly from the inner diameter 207 of the outermost housing sections 202, 2014 and is interdigitated amongst the axial fins 214. When the resilient members 205 are rotationally deformed under external force from the propulsion device 10 or marine vessel, the electromagnetic fluid is free to flow in cavities 218 formed between the axial fins 214 and axial baffles 216, from cavity 218 to cavity 218, around the axial fins 214 and axial baffles 216. Thus the shape and spacing of the axial fins 214 and axial baffles 216 defines the cavities 218 and the pathways for the flow of electromagnetic fluid. When rotational motion occurs, the controller 30 and electromagnets 22*a*, 22*c* control the shear strength of the electromagnetic fluid (as described above) and opposing fins 214 and baffles 216 rotate with respect to each other and shear the electromagnetic fluid 24 there between. In this way, the shear strength of the electromagnetic fluid, as affected by the electromagnets 22*a*, 22*c*, determines the resiliency of the mount 260*b* to rotation.

In this example, the housing 200 advantageously is a modular housing configuration, wherein the designer can add or subtract housing sections from the housing 200 to thereby modify the elasticity of the mount 260*b*. In the illustrated configuration, the outermost housing sections 202, 204 control the resistance of the mount 260*b* to twisting and vertical/horizontal motions. The innermost housing section 203 controls the resistance of the mount 260*b* to axial and tipping motions.

Figure 12:
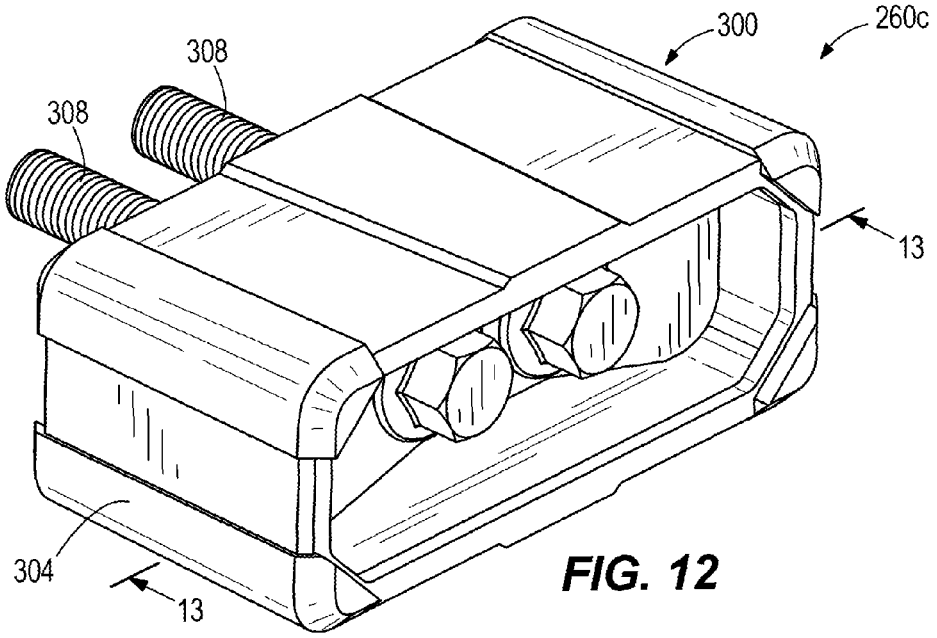
FIGS. 12-14 depict a third example of an elastic mount according to the present disclosure.
Figure 13:
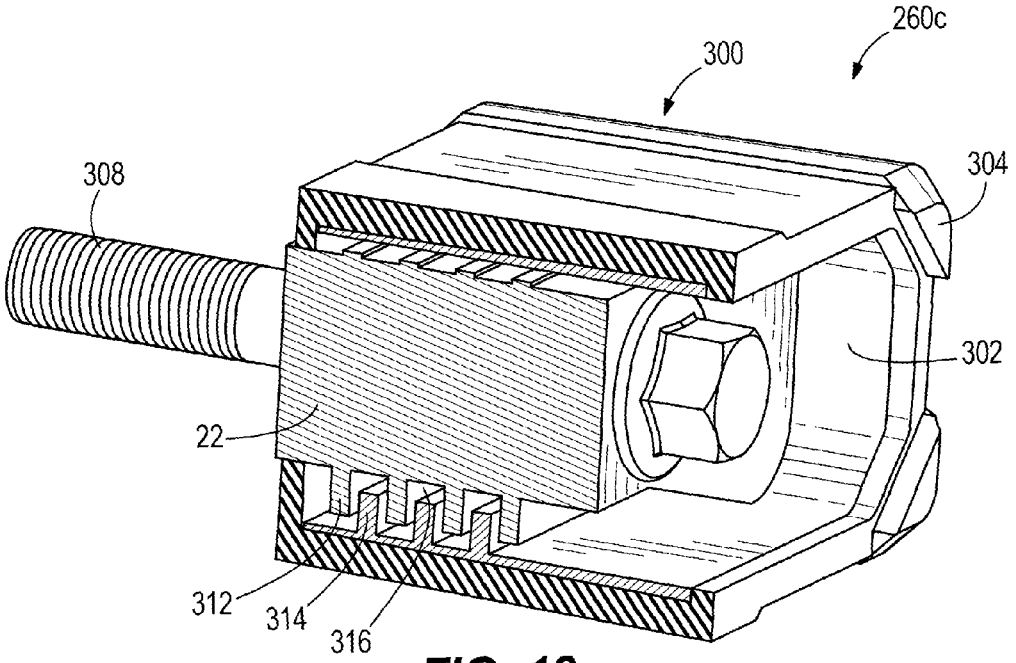
Figure 14:
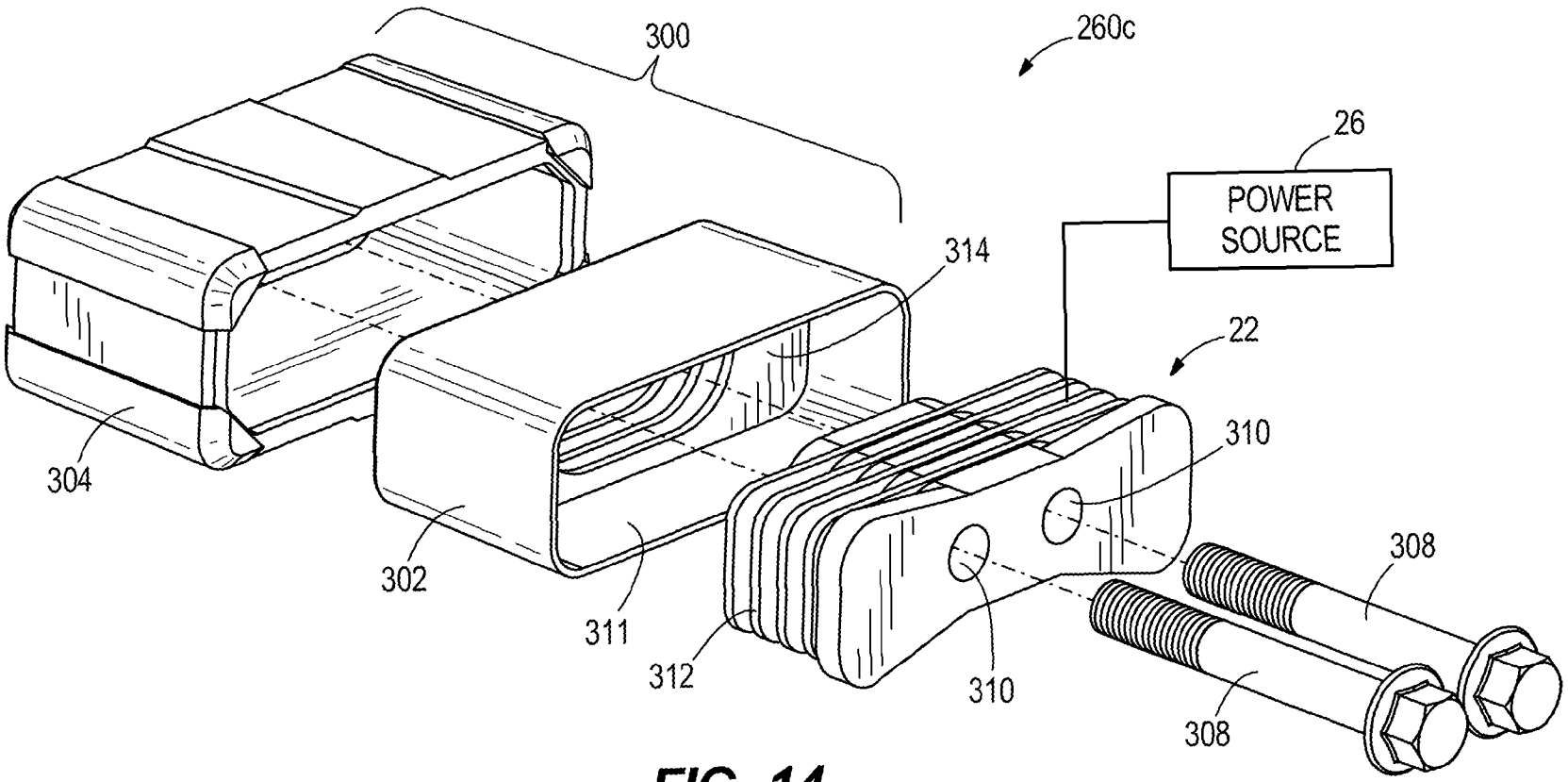

FIGS. 12-14 depict a third example of a mount 260*c* for supporting the propulsion device 10 with respect to the marine vessel. The mount 260*c* is designed to replace the mounts 16*a* shown in FIG. 1, which are disposed between connection points of the propulsion device 10 and marine vessel, including at the drive shaft housing 20 of the propulsion device 10.

In this example, the mount 260*c* includes a housing 300 that includes a metal shell 302 surrounded by a rubber cover 304. An electromagnet 22 is disposed in the housing 300. A pair of elongated connectors 308 extends though a pair of through-bores 310 in the electromagnet 22. The electromagnet 22 includes a plurality of radial fins 312. The inner diameter 311 of the metal shell 302 includes a plurality of radial baffles 314 that are interdigitated amongst the radial fins 312. Electromagnetic fluid is retained in the housing 300 and free to flow around the radial fins 312 and radial baffles 314 when the elastic mount 260*c* is subjected to axial forces along the elongated connectors 308 from movement of the propulsion device 10 and/or marine vessel. Cavities 316 are defined between the housing 300 and the electromagnet 306 in which the electromagnetic fluid resides. As described herein above, the electromagnet 22 is connected to a battery 26 and configured so that increasing an amount of electricity applied to the electromagnet 22 increases the shear strength of an electromagnetic fluid in the mount 260*c* thereby decreasing elasticity of the mount 260*c*, and so that decreasing the amount of electricity applied to the electromagnet 22 decreases the shear strength of the electromagnetic fluid in the mount 260*c* thereby increasing the elasticity of the mount 260*c*.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A system for supporting a propulsion device with respect to a marine vessel, the system comprising:

an elastic mount configured to support the propulsion device with respect to the marine vessel, wherein the elastic mount contains an electromagnetic fluid;

an electromagnet configured so that increasing an amount of electricity applied to the electromagnet increases the shear strength of the electromagnetic fluid in the elastic mount and thereby decreases elasticity of the elastic mount, and further configured so that decreasing the amount of electricity applied to the electromagnet decreases the shear strength of the electromagnetic fluid in the elastic mount and thereby increases the elasticity of the elastic mount; and a controller configured to automatically adapt the amount of electricity applied to the electromagnet during translation of the marine vessel so as to reduce a likelihood that the propulsion device impacts an adjacent structure on the marine vessel as a result of motion of the propulsion device caused by environmental forces including wind and waves.

2. The system according to claim 1, wherein the adjacent structure is another propulsion device on the marine vessel.

3. The system according to claim 1, wherein the controller is configured to automatically increase the amount of electricity applied to the electromagnet when the controller determines that the propulsion device has become more likely to impact the adjacent structure and wherein the controller is further configured to automatically decrease the amount of electricity applied to the electromagnet when the controller determines that the propulsion device has become less likely to impact the adjacent structure.

4. The system according to claim 3, further comprising an steering angle sensor configured to sense a present steering angle of the propulsion device, wherein the controller is configured to determine whether the propulsion device has become more or less likely to impact the adjacent structure based at least in part upon the present steering angle of the propulsion device.

5. The system according to claim 4, wherein the controller is configured to increase the amount of electricity applied to the electromagnet when the present steering angle becomes greater than a threshold steering angle value and wherein the controller is configured to decrease the amount of electricity applied to the electromagnet when the present steering angle becomes less than the threshold steering angle value.

6. The system according to claim 3, further comprising a motion sensor configured to sense a present motion of the propulsion device with respect to the marine vessel, wherein the controller is configured to determine whether the propulsion device has become more or less likely to impact the adjacent structure based at least in part upon the present motion of the propulsion device with respect to the marine vessel.

7. The system according to claim 6, wherein the controller is configured to increase the amount of electricity applied to the electromagnet when the present motion of the propulsion device becomes greater than a threshold motion value and wherein the controller is configured to decrease the amount of electricity applied to the electromagnet when the present motion of the propulsion device becomes less than the threshold motion value.

8. The system according to claim 3, further comprising an engine speed sensor configured to sense a present speed of an engine associated with the propulsion device, wherein the controller is configured to determine whether the propulsion device has become more or less likely to impact the adjacent structure based at least in part upon the present speed of the engine.

9. The system according to claim 8, wherein the controller is configured to increase the amount of electricity applied to the electromagnet when the present speed of the engine becomes greater than a threshold engine speed value and wherein the controller is configured to decrease the amount of electricity applied to the electromagnet when the present speed of the engine becomes less than the threshold engine speed value.

10. The system according to claim 3, further comprising an accelerometer configured to sense a state of acceleration of the marine vessel, wherein the controller is configured to determine whether the propulsion device has become more or less likely to impact the adjacent structure based at least in part upon the state of acceleration of the propulsion device.

11. The system according to claim 10, wherein the controller is configured to increase the amount of electricity applied to the electromagnet when the present state of acceleration of the propulsion device becomes greater than a threshold acceleration value and wherein the controller is configured to decrease the amount of electricity applied to the electromagnet when the present state of acceleration of the propulsion device becomes less than the threshold acceleration value.

12. The system according to claim 3, further comprising a trim position sensor configured to sense a present trim position of the propulsion device, wherein the controller is configured to determine whether the propulsion device has become more or less likely to impact the adjacent structure based at least in part upon the present trim position of the propulsion device.

13. A system for supporting a propulsion device with respect to a marine vessel, the system comprising:

an elastic mount that supports the propulsion device with respect to the marine vessel;

an electromagnet configured so that increasing an amount of electricity applied to the electromagnet increases the shear strength of an electromagnetic fluid in the elastic mount thereby decreasing elasticity of the elastic mount, and so that decreasing the amount of electricity applied to the electromagnet decreases the shear strength of the electromagnetic fluid in the elastic mount thereby increasing the elasticity of the elastic mount; and a controller configured to automatically adapt the amount of electricity applied to the electromagnet during translation of the marine vessel so as to reduce a likelihood that the propulsion device impacts an adjacent structure on the marine vessel as a result of motion of the propulsion device caused by environmental forces including wind and waves, wherein the controller is configured to automatically increase the amount of electricity applied to the electromagnet when the controller determines that the propulsion device has become more likely to impact the adjacent structure and wherein the controller is further configured to automatically decrease the amount of electricity applied to the electromagnet when the controller determines that the propulsion device has become less likely to impact the adjacent structure;

wherein the controller is configured to determine the likelihood that the propulsion device impacts the adjacent structure on the marine vessel based at least in part on a present speed of an engine associated with the propulsion device and a present motion of the propulsion device with respect to the marine vessel.

14. The system according to claim 13, wherein the controller comprises a memory and a further comprising a map stored in the memory, wherein the map correlating speed of the engine and motion of the propulsion device with respect to the marine vessel to the amount of electricity applied to the electromagnet, wherein the controller is configured to determine the likelihood that the propulsion device impacts the adjacent structure on the marine vessel based upon the map.

15. A system for supporting a propulsion device with respect to a marine vessel, the system comprising:

an elastic mount that supports the propulsion device with respect to the marine vessel;

an electromagnet configured so that increasing an amount of electricity applied to the electromagnet increases the shear strength of an electromagnetic fluid in the elastic mount thereby decreasing elasticity of the elastic mount, and so that decreasing the amount of electricity applied to the electromagnet decreases the shear strength of the electromagnetic fluid in the elastic mount thereby increasing the elasticity of the elastic mount; and a controller configured to automatically adapt the amount of electricity applied to the electromagnet during translation of the marine vessel so as to reduce a likelihood that the propulsion device impacts an adjacent structure on the marine vessel as a result of motion of the propulsion device caused by environmental forces including wind and waves, wherein the controller is configured to automatically increase the amount of electricity applied to the electromagnet when the controller determines that the propulsion device has become more likely to impact the adjacent structure, wherein the controller is further configured to automatically decrease the amount of electricity applied to the electromagnet when the controller determines that the propulsion device has become less likely to impact the adjacent structure, and wherein the controller is configured to determine the likelihood that the propulsion device impacts the adjacent structure on the marine vessel based at least in part on a present speed of an engine associated with the propulsion device and a present steering angle of the propulsion device.

16. The system according to claim 15, wherein the controller comprises a memory and a further comprising a map stored in the memory, the map correlating speed of the engine and steering angle of the propulsion device to the amount of electricity applied to the electromagnet, wherein the controller is configured to determine the likelihood that the propulsion device impacts the adjacent structure on the marine vessel based upon the map.

17. A method for supporting a propulsion device with respect to a marine vessel, the method comprising:

providing an elastic mount that supports the propulsion device with respect to the marine vessel;

configuring an electromagnet so that increasing an amount of electricity applied to the electromagnet increases the shear strength of an electromagnetic fluid in the elastic mount thereby decreasing elasticity of the elastic mount, and so that decreasing the amount of electricity applied to the electromagnet decreases the shear strength of the electromagnetic fluid in the plastic mount thereby increasing the elasticity of the elastic mount; and automatically adapting the amount of electricity applied to the electromagnet during translation of the marine vessel so as to reduce a likelihood that the propulsion device impacts an adjacent structure on the marine vessel as a result of motion of the propulsion device caused by environmental forces including wind and waves.

18. The method according to claim 17, further comprising increasing the amount of electricity applied to the electromagnet when the propulsion device becomes more likely to impact the adjacent structure and decreasing the amount of electricity applied to the electromagnet when the propulsion device has become less likely to impact the adjacent structure.

19. The method according to claim 18, further comprising determining the likelihood that the propulsion device impacts the adjacent structure on the marine vessel based at least in part on a present speed of an engine associated with the propulsion device and a present motion of the propulsion device with respect to the marine vessel.

20. The method according to claim 18, further comprising determining the likelihood that the propulsion device impacts the adjacent structure on the marine vessel based at least in part on a present speed of an engine associated with the propulsion device and a present steering angle of the propulsion device.

* * * * *